US005121095A

United States Patent [19]

Ubukata et al.

[11] Patent Number: 5,121,095

[45] Date of Patent: Jun. 9, 1992

[54] THERMALLY RESPONSIVE SWITCH

[75] Inventors: Susumu Ubukata, Kabushiki Kaisha Ubutaka Seisakusho 4-30, Hosho-cho, Minami-ku, Nagoya-shi, Aichi-ken; Yasukazu Mizutani, Nagoya, both of Japan

[73] Assignee: Susumu Ubukata, Nagoya, Japan

[21] Appl. No.: 653,958

[22] Filed: Feb. 12, 1991

[30] Foreign Application Priority Data

Feb. 14, 1990 [JP] Japan ..... 2-32662

[51] Int. Cl.[5] ..... H01H 37/54; H01H 37/04

[52] U.S. Cl. ..... 337/365; 337/354; 337/380; 29/622

[58] Field of Search ..... 337/365, 372, 380, 343, 337/97, 89, 354; 29/622, 623

[56] References Cited

U.S. PATENT DOCUMENTS 4,334,210 6/1982 Boulanger et al. ..... 337/354

4,970,485 11/1990 Wahls ..... 337/354

*Primary Examiner*—Harold Broome

*Attorney, Agent, or Firm*—Foley & Lardner

[57] ABSTRACT

A thermal motor protector includes a cylindrical metal housing having an open end and a bimetal disposed in the housing so that its one side is opposite to an housing inner bottom. The bimetal has a shallow dish-shaped portion so that it inverts its curvature at a first temperature with a snap action and re-inverts its curvature at a second temperature. A support is disposed in the housing opposite to the other side of the bimetal and has a preselected elasticity. A fixed contact member is disposed in the housing, and a movable contact member is held by a stationary member in the housing so as to be movable relative to the fixed contact member. A pressure strip is formed separately from or integrally with the movable contact member so as to project from and to be moved with it, the pressure strip having a distal end in contact with the support so that a force is applied to the bimetal at a predetermined pressure. A header plate is secured to the housing so as to hermetically close the open end of the housing, the header plate having at least one opening, and a terminal pin is hermetically held in the header plate opening with an electrically insulating material charged between them.

17 Claims, 3 Drawing Sheets

THERMALLY RESPONSIVE SWITCH

BACKGROUND OF THE INVENTION

This invention relates to a thermally responsive switch which is suitable for disposition in automobiles so as to sense the temperature of an overheated portion in the case of an abnormal condition of a transmission or compressor recirculating a refrigerant through a heat-exchange system and so as to be responsive to the abnormal temperature to thereby open an electrical circuit to deenergize an electromagnetic clutch transmitting power to the compressor or to thereby operate a warning device in the case of the engine or transmission to be protected.

In automobiles, engine power is conventionally transmitted to a compressor of an air conditioning system through an electromagnetic clutch, thereby driving the compressor. A thermally responsive switch is employed for sensing an abnormal temperature in the overheat condition of the compressor due to the influence of the ambient temperature or reduction in the lubrication effect due to a shortage of a refrigerant, and interrupting the operation of the compressor or warning of the compressor overheat condition, thereby opening an electric circuit.

The above-described thermally responsive switch is disclosed in Japanese Published Patent Application (Kokoku) No. 40-27898, Japanese Laid-open Patent Application (Kokai) No. 62-143330 and Japanese Laid-open Utility Model Reg. Application (Kokai) No. 61-3648. In such conventional thermally responsive switches, a thermally responsive element formed of a dish-shaped bimetal, inverting its curvature with a snap action when subjected to heat or the like, rests on the inner bottom face of a housing enclosing the element or disposed in the housing with a gap between the circumference of the thermally responsive element and the inner circumferential wall of the case. The gap is so determined that inversion of the thermally responsive element is not prevented by the housing inner circumferential wall. In these conventional thermally responsive switches, unstable contact between the thermally responsive element and the housing inner face or the presence of the gap therebetween causes variations in the heat transmission. Furthermore, a relatively long thermal response period results in problems of the stability of the operating temperature. Additionally, parts employed in the conventional thermally responsive switches need a high level of accuracy and too much time in the assembly.

SUMMARY OF THE INVENTION

Therefore, an object of the present invention is to provide a thermally responsive switch wherein the heat transmission and heat exchange between the thermally responsive element and the housing enclosing can be improved so that the stability of the operating temperature is ensured and the quality of the products can be easily stabilized by the execution of an operating temperature calibrating step during assembly, and the parts can be provided with sufficient allowance for the accuracy.

The thermally responsive switch of the present invention comprises a hermetically sealed housing enclosing fixed and movable contact members. A dish-shaped thermally responsive element is disposed in the housing so that one of two sides of the thermally responsive element is opposite to a housing inner bottom. A support is also disposed in the housing so as to be opposite to the other side of the thermally responsive element. The support has a predetermined elasticity. A pressure strip is provided on the movable contact member so as to project from the movable contact member and be moved with the same. Alternatively, the pressure strip may be formed integrally with the movable contact member. The projected end of the pressure strip is in contact with or secured to the support. Accordingly, the pressure is applied to the support by the pressure strip such that the thermally responsive element is usually pressed slightly against the housing inner bottom face. Consequently, since the thermally responsive element is in stable contact with the housing inner bottom face, the heat conductivity and heat exchange effectiveness between the thermally responsive element and the housing inner bottom face ma be improved and stabilized. Furthermore, the operation of the thermally responsive element may be stabilized with less occurrence of chattering.

Furthermore, to execute the calibration for adjusting the relative reference position of the pressure strip, the housing bottom wall may be easily deformed inward after the housing is hermetically sealed. In consideration of an amount of inward deformation of the housing bottom wall, the length of the housing is designed to be initially slightly larger than an expected dimension after the calibration.

Other objects of the present invention will become obvious upon understanding of the illustrative embodiment about to be described or will be indicated in the appended claims. Various advantages not referred to herein will occur to one skilled in the art upon employment of the invention in practice.

DESCRIPTION OF THE PREFERRED EMBODIMENTS

Figure 1:
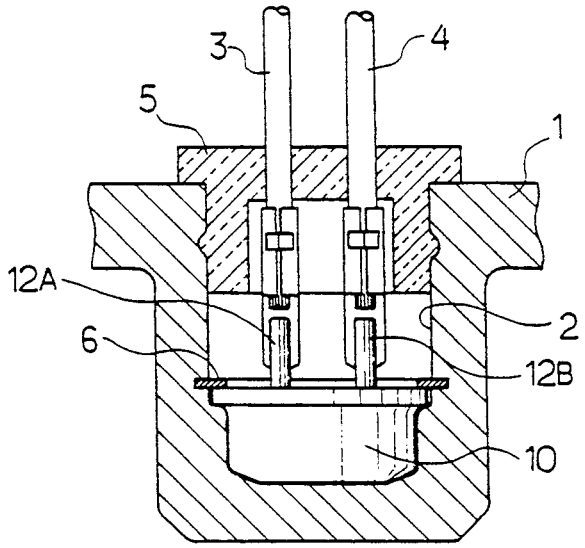
FIG. 1 is a partially longitudinal section of a mounting recess of an object to be protected by a thermally responsive switch in accordance with an embodiment of the present invention, the switch being disposed in the concave portion.

Several embodiments of the present invention will be described with reference to the accompanying drawings. FIG. 1 illustrates a mounting recess 2 provided on a compressor or transmission housing 1 of an automobile. In accordance with the present invention, a thermally responsive switch 10 is enclosed in the mounting recess 2 to be held by a fastening plate 6 such as a ring spring so as to be fixed in position. Terminal pins 12A and 12B are electrically connected to respective leads 3 and 4, which are further connected to an electrical circuit of an equipment to be protected against overheating, through a rubber waterproof closure 5 closing an opening of the mounting recess 2.

Figure 2:
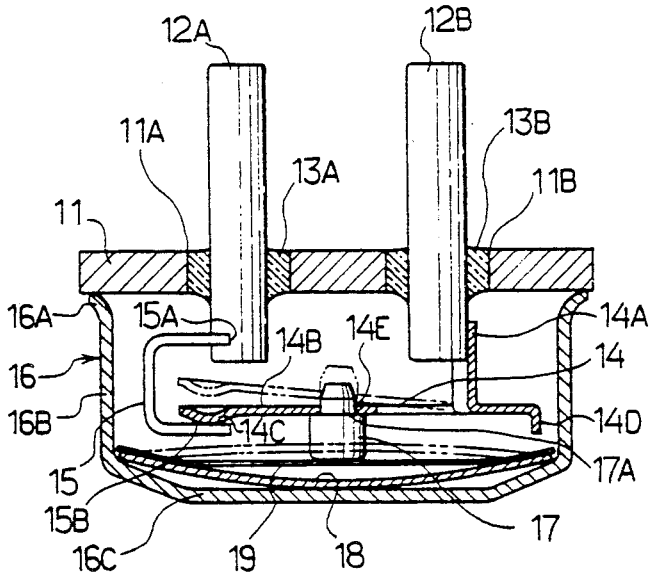
FIG. 2 is an enlarged longitudinal section of the thermally responsive switch.
Figure 3:
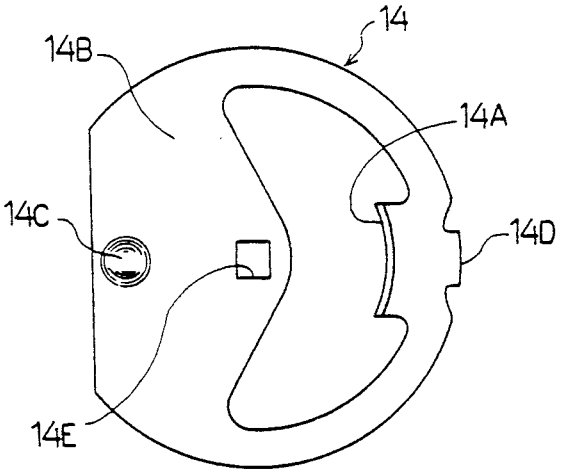
FIG. 3 is a top plan view of a movable contact member employed in the thermally responsive switch.

FIG. 2 illustrates, in more detail, the thermally responsive switch shown in FIG. 1. A circular header plate 11 is formed by stamping a relatively thick steel plate and has two through-holes 11A and 11B. The terminal pins 12A, 12B, each formed of an iron-nickel alloy, are inserted through the holes 11A and 11b, respectively. Electrically insulating sealant materials 13A and 13B such as glass are disposed in the holes 11A, 11B, respectively in consideration of the thermal expansion coefficiency of the terminal pins 12A, 12B. A generally U-shaped fixed contact member 15 is secured at the upper end 15A to the lower side of the terminal pin 12A by way of the butt spot welding, as viewed in FIG. 2. The fixed contact member 15 is formed of a thick phosphor bronze plate or the like. The upper face of the lower end of the fixed contact member 15 serves as an electrical contact portion 15B, as viewed in FIG. 2. In the case where a large amount of current flows in the circuit which is protected by the thermally responsive switch, a separate fixed contact needs to be secured to the contact portion 15B. In the embodiment, however, the silver plating is applied to the contact portion 15B since the thermally responsive switch is applied to a circuit in which a small amount of current flows. The silver plating is also applied to a contact portion 14C of a movable contact member 14 in the same manner as described above. The movable contact member 14 is secured at a securing portion 14A to the lower end of the terminal pin 12B by the spot welding in a cantilever relation, as viewed in FIG. 2. The movable contact member 14 is formed from a spring material such as phosphor bronze or beryllium copper. FIG. 3 shows a plane configuration of the movable contact member 14. The movable contact member 14 includes a movable portion 14B substantially perpendicular to the terminal pin 12B, a securing portion 14A secured to the terminal pin 12B, and a limiting portion 14D extended from the securing portion 14B and bent downward, as viewed in FIG. 2. The movable portion 14B has a central aperture 14E in which a pressure strip 17 is secured. The pressure strip 17 is formed from a heatproof synthetic resin or ceramics, for example. The pressure strip 17 has an upper slender portion 17A inserted into the aperture 14E of the movable contact member 14 so that the pressure strip 17 is secured. The aperture 14E is generally square as shown in FIG. 3. In the case where the pressure strip 17 is formed from a hard material such as ceramics, the slender portion 17A is formed into a column having a circumference slightly larger than the opposite side dimensions of the aperture 14E and forced into the aperture 14E. On the other hand, where the pressure strip 17 is formed from a thermoplastic synthetic resin, the aperture 14E is formed so as to have a circular configuration instead of the square configuration and the slender portion 17A thereof is formed so as to have a diameter somewhat smaller than the aperture diameter. The circular slender portion 17A is inserted into the aperture 14A, and then the pressure strip slender portion is heated with a jig such as a headed flat iron so as to have a temperature higher than the melting temperature of the synthetic resin composing the pressure strip 17, so that the pressure strip slender portion is deformed and fitted in the aperture to be thereby bonded therein. The securing portion 14A of the movable contact member 14 is rendered arc-shaped for enhancement of its stiffness, as shown in FIG. 3.

Figure 4:
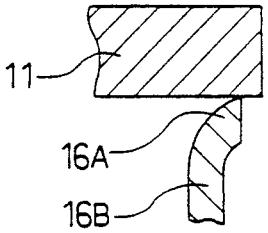
FIG. 4 is an enlarged partial sectional view of a portion of the thermally responsive switch in a step of the assembly.
Figure 5:
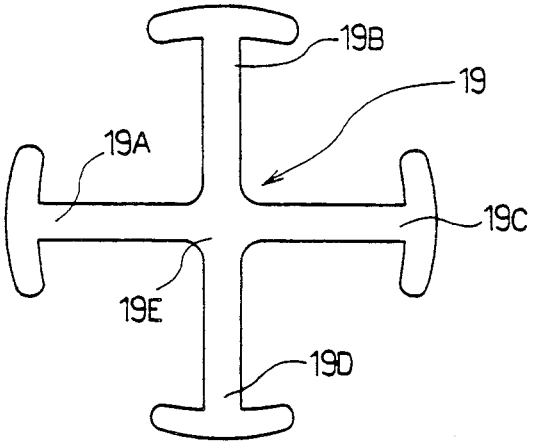
FIG. 5 is a top plan view of a support employed in the thermally responsive switch.

FIG. 4 illustrates an enlarged part of a distal edge of a housing 16 in the state immediately before the welding of the housing 16 to the header plate 11. As shown, a housing rim portion 16A has a sharp edge so as to be suitable for the ring projection welding. The edge may be rendered uniform over its entire circumference by way of the press working with ease and cost effectiveness. The housing 16 includes a cylindrical portion 16B and a bottom 16C in addition to the rim portion 16A. The housings of the same configuration can be formed easily by drawing rolled steel plates for mass production. A thermally responsive element 18 is disposed on the bottom face 16C of the housing 16. The thermally responsive element 18 is formed by blanking a bimetallic or trimetallic material circularly and further shaping a circular blanked material into the shape of a generally shallow dish. On the thermally responsive element 18 is disposed a support 19 formed of a relatively thin spring metal material such as a phosphor bronze plate. FIG. 5 shows a plane configuration of the support 19. The rim portion 16A of the housing 16 is hermetically welded to the header plate 11 in the state shown in FIG. 2. The support 19 includes a central portion 19E in contact with the pressure strip 17 and, for example, four extended portions radially extended from the central portion 19E in the respective different directions. A distal end of each extended portion is adapted to push the circumference of the thermally responsive element 18 with a small force as will be described later.

The operation of the thermally responsive switch thus constructed will now be described. The upper side of the thermally responsive element 18 is the high expansion side and the lower side thereof is the low expansion side as viewed in FIG. 2. As shown, the central portion of the thermally responsive element 18 is expanded downward as shown by a solid line at room temperature. The thermally responsive element 18 inverts its curvature with a snap action when the temperature is increased to a predetermined temperature, for example, at 160° C. such that the central portion is expanded upward as shown by an alternate long and two short dashes line in FIG. 2. The pressure strip 17 is raised via the support 19 by the upwardly expanded central portion of the thermally responsive element 18, which raises the movable portion 14B of the movable contact member 14, thereby disengaging the contact portion 14C from the contact portion 15B of the, fixed contact member 15 to open the electric circuit, thus protecting the equipment against the overheating. When the temperature of the equipment is decreased to, for example, 130° C., the thermally responsive element 18 re-inverts its curvature with the snap action to return to the former downwardly expanded state. A force raising the pressure strip 17 is rapidly removed. The elasticity of the movable contact member 14 causes the movable portion 14B thereof to return downward such that the contact portion 14C is brought into contact with the contact portion 15B of the fixed contact member 15, whereby the equipment may be re-driven. Although the thermally responsive switch 10 described above is of the normally closed type and opens the electric circuit in the abnormal condition, it may be of a normally open type to close the electric circuit in the abnormal condition.

Figure 6:
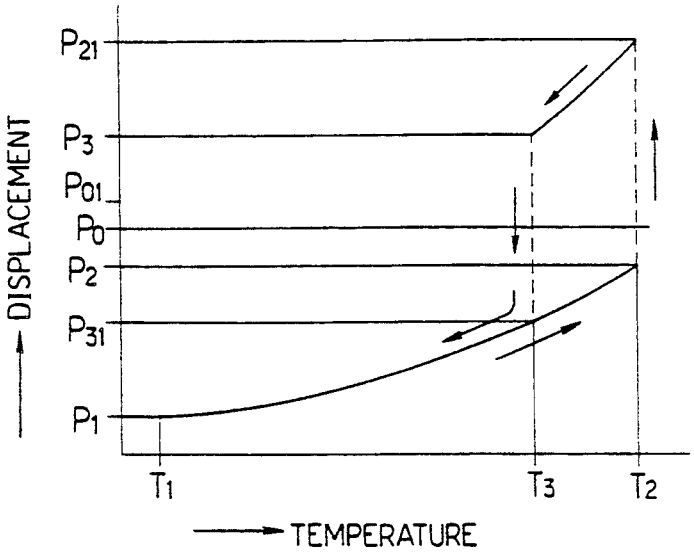
FIG. 6 is a graph illustrating a deformation-temperature characteristic of the thermally responsive element employed in the thermally responsive switch.

FIG. 6 shows a displacement-temperature characteristic of the thermally responsive element of the embodiment. The thermally responsive element 18 has a diameter of 12 mm, thickness of 0.18 mm, weight of about 0.2 grams and specific deflection of approximately $K=1\times10^{-5}\cdot°C.^{-1}$. The thermally responsive element 18 is adapted to invert its curvature at the above-mentioned first temperature, 160° C. and re-invert its curvature at the second temperature, 130° C. In FIG. 6, an axis of abscissas represents the temperature and an axis of ordinates the displacement of the center of the thermally responsive element 18 relative to the circumference thereof. A point $P_0$ on the axis of ordinates represents the position of the circumference of the thermally responsive element 18 in the normal condition. A point $P_1$ represents the position of the thermally responsive element 18 center relative to the circumference thereof at the temperature of $T_1$ or 25° C., which position will be referred to as "central position." Thereafter, the central position is represented by a point $P_2$ when the temperature is increased to the value immediately before the temperature of $T_2$ or 160° C. That is, the thermally responsive element 18 is gradually deformed into a nearly flat shape in an interval between $T_1$ and $T_2$. When the temperature reaches $T_2$, the thermally responsive element 18 inverts its curvature with the snap action such that the central position is represented by a point $P_{21}$. Subsequently, when the temperature is decreased, the center of the thermally responsive element 18 is gradually displaced in an interval between $T_2$ and the value immediately before the temperature of $T_3$ or 130° C. such that the thermally responsive element 18 is deformed into a nearly flat shape. The central position is represented by a point $P_3$. When the temperature reaches $T_3$, the thermally responsive element 18 re-inverts its curvature with the snap action such that the central position is represented by a point $P_{31}$. When the temperature is further decreased to the room temperature, the center of the thermally responsive element 18 takes the position represented by the point $P_1$. Thus, the displacement of the thermally responsive element 18 center shows a characteristic like a hysteresis loop. An amount of displacement of the thermally responsive element 18 center in the interval between $P_2$ and $P_3$ is effective for the snap action for disengaging the movable contact member from the fixed contact member. Accordingly, it is readily understood that a desirable position of the bottom face of the pressure strip 17 secured to the movable contact member 14 is presented by a point $P_{01}$ which is the middle of the interval between $P_3$ and $P_2$. In the embodiment, the underside of the metal support 19 is adapted to take the position represented by the point $P_{01}$ in consideration of the thickness of the support 19. More specifically, the position of $P_1$ from $P_0$ is −0.25 mm, the position of $P_2$ from $P_0$−0.05 mm, the position of $P_{21}$ from $P_0$ 0.25 mm, the position of $P_3$ from $P_0$ 0.12 mm and the position of $P_{31}$ from $P_0$ 0.035 mm. Accordingly, the support 19 underside face contacting the pressure strip 17 needs to be positioned in the range represented by $P_{01}=0.035\pm0.085$ in the interval of the snap action of the thermally responsive element 18 between $P_2$ and $P_3$. When the underside face of the support 19 is outside the range, that is, when the position of the support 19 underside face is represented by a point lower than $P_2$ or higher than $P_3$, chattering occurs when the contact portion 14C of the movable contact member 14 is alternately disengaged from and engaged with the contact portion 15B of the fixed contact member 15. Accordingly, in design of the housing 16, the distance between the housing open end 16A and the pressure strip 17 underside face is previously estimated when the thermally responsive element 18 is placed on the bottom 16C of the housing 16. The depth of the housing 16 is then determined so that the position of the pressure strip 17 underside face is represented by the point $P_{01}$ in consideration of the above-mentioned estimated distance and the thickness of the metal support 19. Actually, however, the housing open end 16A is slightly melted when secured to the header plate 11 by way of the ring welding, which slightly reduces the depth of the housing 16. Accordingly, the depth of the housing 16 needs to be slightly larger so that the slight decrease in the housing depth by the welding is compensated for.

It is confirmed that the change in the height of the central portion of the thermally responsive element 18 is so small as not to be measured when a load of 60 grams is applied to the central portion of the thermally responsive element 18 in the state that the thermally responsive element 18 is expanded upward after inversion thereof. Consequently, it is confirmed that a contact pressure of about 30 grams is obtained at the contact portion 14C when the load of 60 grams is applied to the thermally responsive element 18 through the distal end of the pressure strip 17 secured to the movable contact member 14, as viewed in FIG. 2 and that the contact gap in this case is 0.34 mm, which value is about twice as long as the interval between $P_2$ and $P_3$ obtained from FIG. 6. Furthermore, it is confirmed that almost no effect is exerted on the temperatures at which the thermally responsive element 18 inverts its curvature with the snap action when a force of about 20 grams is applied by the support 19 to the vicinity of the circumference of the thermally responsive element 18 such that the element 18 is usually urged toward the bottom of the housing 16. Consequently, since the thermally responsive element 18 weighs 0.2 grams, it is stationary at the predetermined position when an acceleration applied to the thermally responsive element 18 is below 100G (gravitational unit). Therefore, the thermally responsive switch of the embodiment provides an accurate protecting operation when mounted on a vibrating body which causes the vibration caused by the acceleration below 100G.

Although the underside face of the pressure support 17 is in contact with the central portion 19E of the support 19 in the foregoing embodiment, it may be secured to the support central portion 19E by way of the welding or the like. In this construction, when the thermally responsive switch is mounted on a vibrating body, the central portion 19E of the support 19, formed of a relatively thin metal plate is prevented from colliding with the underside face of the pressure strip 17 and from wear due to rub against the same. Furthermore, when the thermally responsive switch of this construction is mass produced, tolerances of the parts are put together and a small gap occurs between the extended portion of the metal support 19 and the peripheral portion of the thermally responsive element 18 when the things come to the worst. However, such a gap does not hinder actual operation and durability of the thermally responsive switch.

If the thermally responsive switch should fall in handling, the impact acceleration applied to the thermally responsive switch may be in the range between several and several ten times as large as the above-mentioned value, 100G. To cope with such a case, the thermally responsive element 18 is adapted to be received by the fixed contact member 15 and the limiting portion 14D of the movable contact member.

Either of the terminal pin 12A or 12B may be eliminated in the thermally responsive switch of the present invention. In one modified form, when the terminal pin 12A is eliminated, the hole 11A is not formed in the header plate 11, and the fixed contact member 15 is further extended in the direction of the height, as viewed in FIG. 2, and secured to an inside portion of the header plate corresponding to the hole 11A by the welding. Lead wires are connected to the terminal pin 12B and the outside of the header plate 11, respectively, and are further connected to an equipment protected by the thermally responsive switch. Alternatively, a lead wire is connected to the terminal pin 12B and further grounded as the automobile or other body or the earth. On the other hand, in another modified form, when the terminal pin 12B is eliminated, the hole 11B is not formed in the header plate 11 and instead, the securing portion 14A of the movable contact member 14 is further extended and the distal end thereof is bent at right angles. The bent distal end is secured to an inside portion of the header plate 11 corresponding to the hole 11B by the spot welding. In this case, too, the lead wires are connected to the terminal pin 12A and the outside of the header plate 11 and further to the equipment to be protected. Alternatively, a lead wire is connected to the terminal pin 12A and further grounded as the automobile or other body earth. In this case, as further another modified form, instead of the pressure strip 17, a projection may be formed by cutting and downwardly bending a part of the movable contact member 14, or an angled projection may be formed by downwardly expanding the central portion of the movable contact member 14 so that the movable contact member 14 and the pressure strip 17 are integrated. Consequently, the number of parts to be used is advantageously reduced.

The housing 16 is hermetically sealed in the foregoing embodiment, and a gas charged in the housing 16 has a thermal conductivity larger than an atmosphere such that the thermal conduction between the hermetically sealed housing 16 and the thermally responsive element 18 is enhanced. More specifically, the thermal conductivity of air at 20° C. is approximately $6\times10^{-5}$ ($cal.cm^{-1}.sec^{-1}.deg^{-1}$) while that of a helium gas is approximately $30\times10^{-5}$ ($cal.cm^{-1}.sec^{-1}.deg^{-1}$) and that of a hydrogen gas is approximately $37\times10^{-5}$ ($cal.cm^{-1}.sec^{-1}.deg^{-1}$). Thus, there is a large difference between the thermal conductivities of air and helium or hydrogen gas. Furthermore, it is confirmed that the thermal conductivity between the housing and the thermally responsive element is increased when the air pressurized higher than the atmospheric pressure is charged in the housing 16. It is desirable that the gas charged in the housing 16 should contain 1% helium gas for the purpose of confirming the airtightness of the housing 16. The reason for this is that a helium gas mass spectrometer, called a helium leak detector, can be used for that purpose. The helium leak detector has such a precision that the leakage of only 1 cc. of helium during several decades can be detected with accuracy and several tens of switches can be simultaneously inspected by the helium leak detector.

In the embodiment shown in FIG. 2, a compression type hermetic sealing is employed in the case where the two terminal pins 12A, 12B are extended through the respective holes 11A, 11B and secure din position by the respective charging materials 13A, 13B. A matching type hermetic sealing may be employed instead. In the latter type, both terminal pins 12A, 12B may be inserted in a single hole having a diameter well suited for the distance between the two and secured therein. That is, the header plate is formed of an iron-cobalt-nickel alloy generally called "covar" which has a relatively small value of the thermal expansion coefficient. A pair of terminal pins are formed of a material having the thermal expansion coefficient matched with that of the glass material charged in a single hole.

Figure 7:
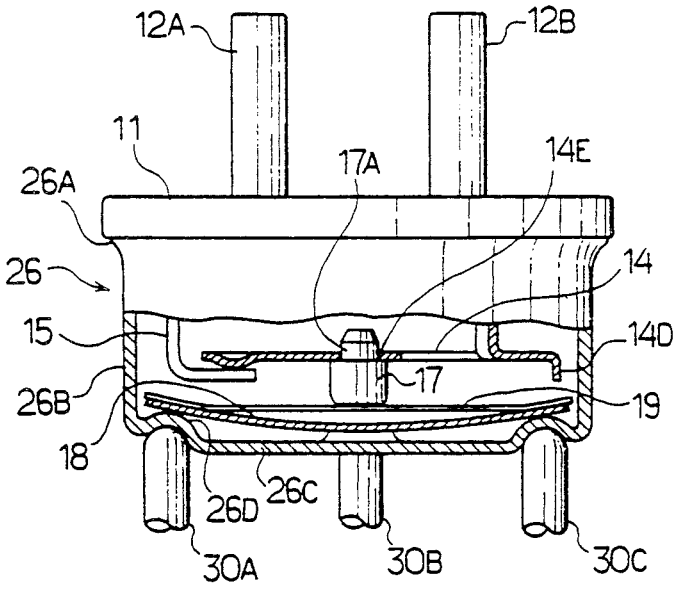
FIG. 7 is a partially broken side view of a thermally responsive switch in accordance with another embodiment of the invention.

A method of making the thermally responsive switch will now be described. As described above, in order that the distal end of the pressure strip is positioned in the region of the snap action of the thermally responsive element, the depth of the housing needs to be determined in consideration of the distance between the header plate underside and the pressure strip bottom and the thickness of each of the support and thermally responsive element. The method in accordance with the invention characteristically includes the following calibration step. That is, the depth of the housing is initially rendered slightly larger than the predetermined value, and an external force is applied to the housing after the hermetic fastening of the housing to the header plate, whereby the substantial dimensions of the housing are adjusted so that the distal end of the pressure strip is positioned in the region of the snap action of the thermally responsive element. More specifically, the housing 26, shown in FIG. 7, is deeper than the housing 16 in FIG. 2 by about 0.3 mm. The circumferential portion of the underside 26C of the housing 26 is deformed by four adjusting jigs 30A, 30B, 30C and 30D (three of which are shown), each having a rounded end so that four inward convex portions 26D are formed as shown in FIG. 7. Detecting the operations of the thermally responsive switch by way of contact opening and closing signals at each step of the deformation of the housing underside 26C, an amount of deformation at each convex portion 26D in contact with the circumference of the thermally responsive element 18 is so determined that the position of the pressure strip 17 secured to the movable contact member 14 is represented by the middle between the snap-acting inverting point and the re-inverting point in the hysteresis loop shown in FIG. 6.

The foregoing disclosure and drawings are merely illustrative of the principles of the present invention and are not to be interpreted in a limiting sense. The only limitation is to be determined from the scope of the appended claims.

We claim:

1. A thermally responsive switch comprising:

(a) a deformable cylindrical metal housing having two ends, one of which ends is open, the housing having a bottom wall at the other end thereof;

(b) a thermally responsive element disposed in the housing so that one of two sides of the thermally responsive element is opposite to an inner bottom of the housing, the thermally responsive element being formed of a thermally deformable material and having a generally shallow dish-shaped portion, the thermally responsive element inverting its curvature at a first predetermined temperature with a snap action and re-inverting its curvature at a second predetermined temperature with the snap action to thereby turn to a former state;

(c) a metal support disposed in the housing opposite to the other side of the thermally responsive element, the support having a predetermined elasticity;

(d)a fixed contact member disposed in the housing, and a movable contact member held by a stationary member in the housing so as to be movable relative to the fixed contact member;

(e) a pressure strip provided on the movable contact member so as to project therefrom and to be moved therewith, the pressure strip having a distal end in contact with the support so that a force is applied to the thermally responsive element at a predetermined pressure;

(f) a metal header plate secured to the housing so as to hermetically close the open end of the housing, the header plate having at least one opening; and (g) a terminal hermetically held in the opening of the header plate with an electrically insulating material inserted therebetween.

2. A thermally responsive switch according to claim 1, wherein the pressure strip is formed integrally with the movable contact member.

3. A thermally responsive switch comprising:

(a) a deformable cylindrical metal housing having two ends, one of which ends is open, the housing having a bottom wall at the other end thereof;

(b) a thermally responsive element disposed in the housing so that one of two sides of the thermally responsive element is opposite to an inner, bottom surface of the housing, the thermally responsive element being formed of a thermally deformable material and having a generally shallow dish-shaped portion, the thermally responsive element inverting its curvature at a first predetermined temperature with a snap action and re-inverting its curvature at a second predetermined temperature with the snap action to thereby turn to a former state;

(c) a metal support disposed in the housing opposite to the other side of the thermally responsive element, the support having a predetermined elasticity;

(d) a fixed contact member disposed in the housing, and a movable contact member held by a stationary member in the housing so as to be movable relative to the fixed contact member;

(e) a pressure strip provided on the movable contact member so as to project therefrom and to be moved therewith, the pressure strip having a distal end secured to the support so that a predetermined positional relationship of the support relative to the thermally responsive element is maintained;

(f) a metal header plate secured to the housing so as to hermetically close the open end of the housing, the header plate having at least one opening; and (g) a terminal hermetically held in the opening of the header plate with an electrically insulating material inserted therebetween.

4. A thermally responsive switch according to claim 3, wherein the pressure strip is formed integrally with the movable contact member.

5. A thermally responsive switch according to claim 1, wherein the terminal comprises first and second terminal pins electrically insulated from each other, and the pressure strip comprises an electrical insulator, the fixed contact member being secured to the first terminal pin, the movable contact member being held by the second terminal pin.

6. A thermally responsive switch according to claim 2, wherein the terminal comprises first and second terminal pins electrically insulated from each other, and the pressure strip comprises and electrical insulator, the fixed contact member being secured to the first terminal pin, the movable contact member being held by the second terminal pin.

7. A thermally responsive switch according to claim 3, wherein the terminal comprises first and second terminal pins electrically insulated from each other, and the pressure strip comprises an electrical insulator, the fixed contact member being secured to the first terminal pin, the movable contact member being held by the second terminal pin.

8. A thermally responsive switch according to claim 4, wherein the terminal comprises first and second terminal pins electrically insulated from each other, and the pressure strip comprises an electrical insulator, the fixed contact member being secured to the first terminal pin, the movable contact member being held by the second terminal pin.

9. A thermally responsive switch according to claim 1, wherein the housing is filled with a gas having a heat conductivity higher than air.

10. A thermally responsive switch according to claim 2, wherein the housing is filled with a gas having a heat conductivity higher than air.

11. A thermally responsive switch according to claim 3, wherein the housing is filled with a gas having a heat conductivity higher than air.

12. A thermally responsive switch according to claim 4, wherein the housing is filled with a gas having a heat conductivity higher than air.

13. The thermally responsive switch according to claim 1, wherein the metal support comprises a phosphor bronze plate.

14. The thermally responsive switch according to claim 3, wherein the metal support comprises a phosphor bronze plate.

15. A method of making a thermally responsive switch comprising:

(a) securing two terminal pins in two openings formed in a metal header plate by an electrically insulating material inserted therebetween, respectively, and securing an end of a fixed contact member to one of the terminal pins and an end of a movable contact member to the other terminal pin, the movable contact member provided with a pressure strip formed either separately from or integrally with the movable contact member so as to project therefrom and to be moved therewith;

(b) disposing a thermally responsive element on an inner bottom of a deformable cylindrical metal housing so that one side of the thermally responsive element is opposite to the bottom face of the housing, the housing having two ends, one of which is open and the other of which terminates at a bottom wall of the housing the thermally responsive element being formed of a thermally deformable material and having a generally shallow dish-shaped portion, the thermally responsive element inverting its curvature at a first predetermined temperature with a snap action and re-inverting its curvature at a second temperature with the snap action to thereby turn to a former state;

(c) disposing a metal support, having a predetermined elasticity, in the housing opposite to the other side of the thermally responsive element after the thermally responsive element has been disposed in the housing;

(d) securing the metal header plate to the housing so as to hermetically close the open end of the housing and so that a distal end of the pressure strip is in contact with the support; and (e) deforming the housing bottom wall inwardly so that the positional relationship of the support relative to the thermally responsive element is adjusted.

16. A method of making a thermally responsive switch comprising a deformable cylindrical metal housing having two ends, one of which ends is open, the housing having a bottom wall at the other end thereof, a thermally responsive element disposed in the housing so that one of two sides of the thermally responsive element is opposite to an inner, bottom surface of the housing, the thermally responsive element being formed of a thermally deformable material and having a generally shallow dish-shaped portion, the thermally responsive element inverting its curvature at a first predetermined temperature with a snap action and re-inverting its curvature at a second predetermined temperature with the snap action to thereby turn to a former state, a metal support disposed in the housing opposite to the other side of the thermally responsive element, the support having a predetermined elasticity, a fixed contact member disposed in the housing, and a movable contact member held by a stationary member in the housing so as to be movable relative to the fixed contact member, a pressure strip provided ton the movable contact member so as to project therefrom and to be moved therewith, the pressure strip having a distal end in contact with the support so that a force is applied to the thermally responsive element at a predetermined pressure, a metal header plate secured to the housing so as to hermetically close the open end of the housing, the header plate having at least one opening, and a terminal hermetically held in the opening of the header plate with an electrically insulating material inserted therebetween, said method comprising deforming the bottom surface of the housing inwardly so that the relative position of the pressure strip is adjusted, after the header plate, having terminal means hermetically secured in the opening thereof, is hermetically secured to the housing so as to close the open end thereof.

17. A method of making a thermally responsive switch comprising:

(a) hermetically sealing a terminal pin in an opening formed in a metal header plate, and securing one of an end of a fixed contact member and an end of a movable contact member to the terminal pin and the other of the end of the fixed contact member and the end of the movable contact member to an inside surface of the header plate, the movable contact member being provided with a pressure strip formed either separately from or integrally with the movable contact member so as to project therefrom and to be moved therewith;

(b) disposing a thermally responsive element on an inner bottom of a deformable cylindrical metal housing so that one side of the thermally responsive element is opposite to the bottom face of the housing, the housing having two ends, one of which is open and the other of which terminates in a bottom wall of the housing the thermally responsive element being formed of a thermally deformable material and having a generally shallow dish-shaped portion, the thermally responsive element inverting its curvature at a first predetermined temperature with a snap action and re-inverting its curvature at a second temperature with the snap action to thereby turn to a former state;

(c) disposing a metal support, having a predetermined elasticity, in the housing opposite to the other side of the thermally responsive element after the thermally responsive element has been disposed in the housing;

(d) securing the metal header plate to the housing so as to hermetically close the open end of the housing and so that a distal end of the pressure strip is in contact with the support; and (e deforming the housing bottom wall inwardly so that the positional relationship of the support relative to the thermally responsive element is adjusted.

* * * * *